US007020969B2

(12) United States Patent
Roberson

(10) Patent No.: US 7,020,969 B2
(45) Date of Patent: Apr. 4, 2006

(54) STRAIGHT KNIFE WITH LINER LOCK

(76) Inventor: Robbie E. Roberson, 3330 Pearly Anthony Rd., Maryville, TN (US) 37803

( * ) Notice: Subject to any disclaimer, the term of this patent is extended or adjusted under 35 U.S.C. 154(b) by 89 days.

(21) Appl. No.: 10/443,533

(22) Filed: May 22, 2003

(65) Prior Publication Data

US 2004/0231169 A1 Nov. 25, 2004

(51) Int. Cl.
*B26B 3/06* (2006.01)

(52) U.S. Cl. ..... 30/152; 30/160; 30/161

(58) Field of Classification Search ..... 30/160, 30/161, 152, 153, 156, 155
See application file for complete search history.

(56) References Cited

U.S. PATENT DOCUMENTS

| | | | | | |
|---|---|---|---|---|---|
| 821,176 | A | * | 5/1906 | Leland | 30/143 |
| 978,165 | A | * | 12/1910 | Johnson | 30/161 |
| 4,502,219 | A | * | 3/1985 | Hibben | 30/153 |
| 4,606,123 | A | * | 8/1986 | Wrench | 30/153 |
| 4,651,419 | A | * | 3/1987 | Reed, Jr. | 30/152 |
| 5,502,895 | A | | 4/1996 | Lemaire | |
| 5,581,834 | A | | 12/1996 | Collins | |
| 5,685,079 | A | | 11/1997 | Brothers et al. | |
| 5,755,035 | A | | 5/1998 | Weatherly | |
| 5,915,792 | A | * | 6/1999 | Sakurai | 30/161 |
| 5,966,816 | A | * | 10/1999 | Roberson | 30/156 |
| 6,223,372 | B1 | | 5/2001 | Barber | |
| 6,354,007 | B1 | | 3/2002 | Scarla | |

* cited by examiner

*Primary Examiner*—Kenneth E. Peterson
*Assistant Examiner*—Ghassem Alie
(74) *Attorney, Agent, or Firm*—Pitts & Brittian, P.C.

(57) ABSTRACT

A straight knife is disclosed including an interchangeable, pivoting double-ended blade and having a locking member within a handle. A pivot member is inserted through a blade body section to allow pivoting of either blade end to an operative position extended from a blade channel defined by the handle. The locking member is positioned adjacent the blade body section within the blade channel and is composed of a resilient spring material. Upon single-handed manipulation by the user, the locking member is moved from an engaged and locked position to a disengaged position apart from the blade for pivoting of the blade to expose either blade end to an operative position. The blade is removable from the handle upon removal of the pivot member and manipulation of the locking member for inserting another like-configured pivotable blade in the blade channel for single-handedly pivoting the blade to exposed a selected blade end.

3 Claims, 10 Drawing Sheets

STRAIGHT KNIFE WITH LINER LOCK

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to knives having folding blades. More specifically, the present invention relates to a straight knife having a pivotable double-ended blade that is single-handedly pivoted and locked by a user for selecting either one of opposed blade ends for accomplishing a multitude of tasks.

2. Description of the Related Art

Folding knives generally offer a variety of cutting or other tool ends each designed for a special purpose; however, folding knives offer this variety at the expense of the strength offered by a full tang knife. Conversely, straight knives are designed for strength and size. They are generally larger than folding knives and have a fixed blade with a full length which provides excellent strength for rugged activities, such as for hunting. However, a major drawback of straight knives is the limitation of having only one singular-purpose blade.

A hunter in the field has many uses for a knife. For example, a hunter attempting to set up a tree stand may have need to remove small obstructing branches using a saw blade. Should the hunter successfully bring down a game animal, there is further need for specialized blades. Depending upon the size of the animal and its intended use, the hunter may require a drop point blade, a skinning blade, a filleting blade, or a gut hook blade. Such diverse blade requirements would require a hunter to have multiple straight knives on hand and preferably accessible to avoid digging through a pack. Further, carrying multiple knives adds unnecessary weight to the hunter's load and increases the chance of losing valuable equipment in the field.

Additionally, a hunter skinning and/or gutting a game animal may have need to change between two special purpose blades or to change to a secondary sharp blade after the first is dulled. This is a particular concern when the need to change blades occurs in the middle of the skinning or gutting process. Often the hunter will have one hand gripping a portion of the carcass for cutting and the hunter will be reluctant to release that grip simply to rotate the blade. It is therefore desirable to have a knife in which the blade can be rotated with one hand for use of a sharpened blade edge or other blade tool.

Finally, hunters often wear bulky gloves for warmth and protection and have a need of a knife having a straight blade which can be easily manipulated by gloved hands.

Multiple purpose folding knives have been previously disclosed in U.S. Pat. Nos. 5,502,895, 5,581,834, 5,685,079, 5,755,035, 6,223,372, and 6,354,007. The prior art devices typically provide one folding blade that is extended from a closed position in a knife handle to an open position. If the user desires a different cutting edge, an additional folding knife must be carried. The designs of the prior art devices do not allow a user to engage a blade lock mechanism and nearly simultaneously rotate a first blade having a cutting edge to expose a second blade having a second cutting edge or other tool. It is desirable for hunters holding an animal in one hand to utilize only one hand to manipulate a knife. It is also desirable for an emergency response personnel providing assistance to an injured person, to be able to single-handedly manipulate a knife to expose a selected tool to cut seat-belts and/or to remove other obstructions from the injured person.

Furthermore, the prior art devices typically include one single blade edge for each knife. Accordingly, a plurality of folding blades must be carried, or a knife must be disassembled and reassembled to provide a second blade edge or an additional tool. If replacement blades are dropped in the woods, they may or may not be readily recovered. This again requires two-handed operation and the availability of a removal tool, such as a screwdriver.

Accordingly, there is a need for a straight knife which accommodates a double-ended blade which is rapidly pivoted by a user to expose either cutting surface for use. Furthermore, there is a need for a straight knife having a pivotable blade which is easily manipulated with one hand, particularly when the hand is gloved. In addition, there is a need for a straight knife including a double-ended blade having one pivot hole therein and which is rapidly interchanged with a similar sized blade having alternative cutting edges without the need for a uniquely configured removal tool.

BRIEF SUMMARY OF THE INVENTION

A straight knife is disclosed including a pivotable blade with opposed ends each forming a selected tool that can be single-handedly manipulated by a user to expose either end. The knife includes a handle having a blade channel defined along its longitudinal axis and having a pivot end and a base end. A pivotable blade having opposed end sections integrally formed with a body section is pivotably connected within the blade channel. The blade is secured from freely pivoting relative to the handle during use by engagement of at least one lock opening disposed on the blade body section with an engagement end of a locking member positioned in the blade channel. The engagement end is biased to remain extended against the at least one lock opening in a locked position for securing the blade from pivoting. When the user prefers to pivot the blade to extend an opposed blade end section from the pivot end of the handle, a release member is provided that is positioned to extend proximal of the engagement end of the locking member. The engagement end is readily moved to an unlocked position by manipulation of the release member by a user's digit, thereby providing a straight knife that a user can single-handedly manipulate for pivoting the blade relative to the handle and extending either one of the two blade end sections from the handle.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
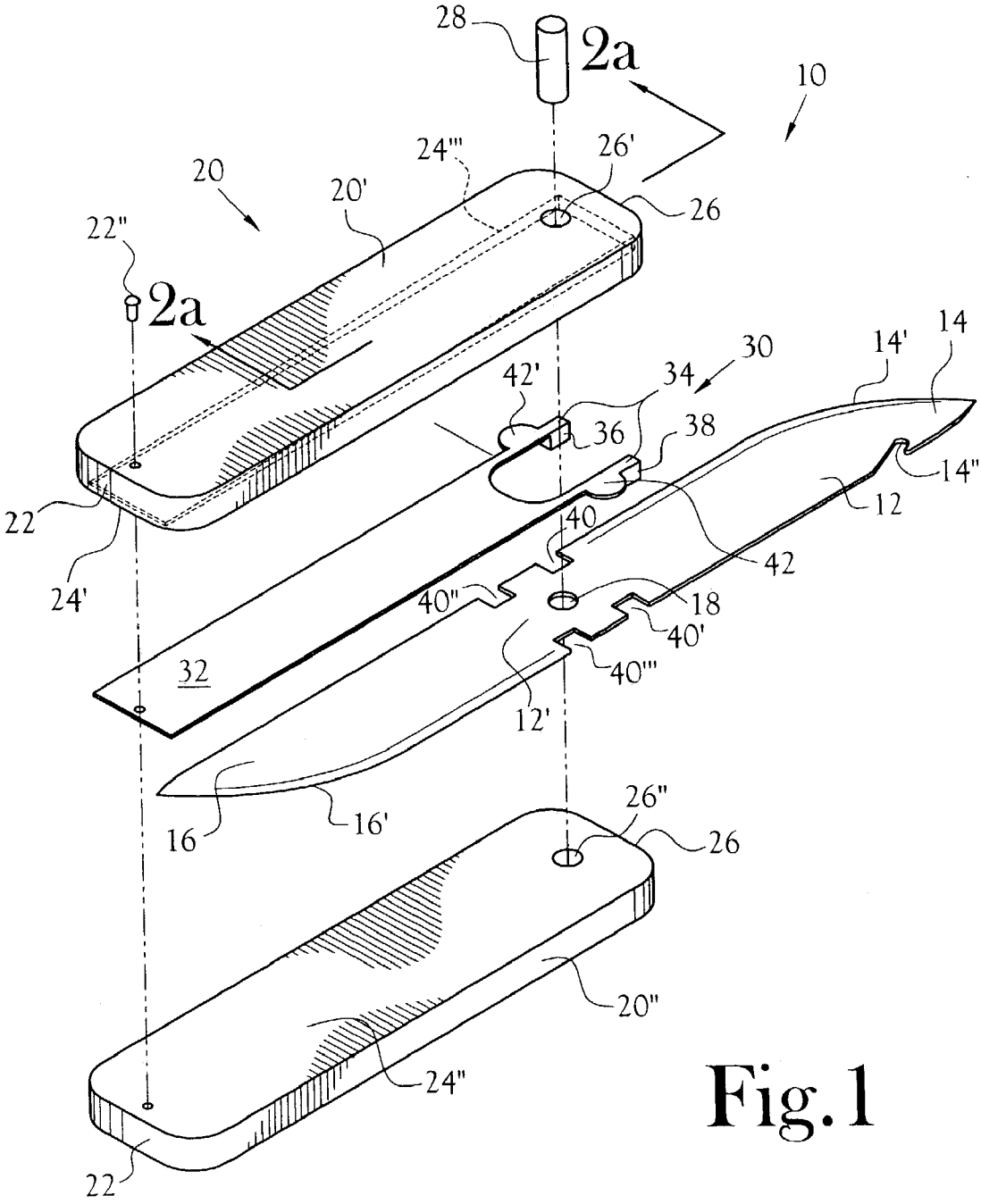
FIG. 1 is an exploded view of a straight knife of the present invention having a double-ended knife pivotably disposed within a handle.

A straight knife 10 is disclosed including a pivotable double-ended blade 12 that can be single-handledly manipulated by a user to expose either one of the blade end sections 14, 16 from an end of an enclosing handle 20. The straight knife is illustrated in an exploded view at 10 in FIG. 1. The blade 12 includes opposed end sections 14, 16 that may include any of a variety of tool elements including opposed blade cutting edges 14', 16', a gutting hook 14", or other tool surfaces known to be utilized by hunters and emergency personnel. The opposed end sections 14, 16 are integrally formed with a body section 12' to provide a rigid, full-length blade member that is pivotably connected within the handle 20 by a pivot member 28 inserted through a blade pivot opening 18. A preferred position for the pivot opening 18 is a central position on the body section 12' that is aligned along the longitudinal axis of the blade 12. The pivot opening 18 can be positioned off-center from the central position of the blade 12 to provide for two unequal cutting surface lengths for the respective blade end sections 14, 16 when either blade end section is separately exposed from the handle 20. For field applications where the user requires either of two sharpened blade cutting edges 14', 16', a gut hook 14", or another tool disposed on one of the opposed blade end sections 14, 16, the pivot member 28 provides the user with a pivoting means to single-handledly pivot the blade 12 to extend either end section 14, 16 from the handle 20. If both cutting edges 14', 16' are dulled, or an alternative serrated blade edge is required by the user, the blade 12 is removed and exchanged with a like-sized blade (not shown) by removal of the pivot member 28 and removal of a base connector 22" from the handle 20.

Figure 2A:
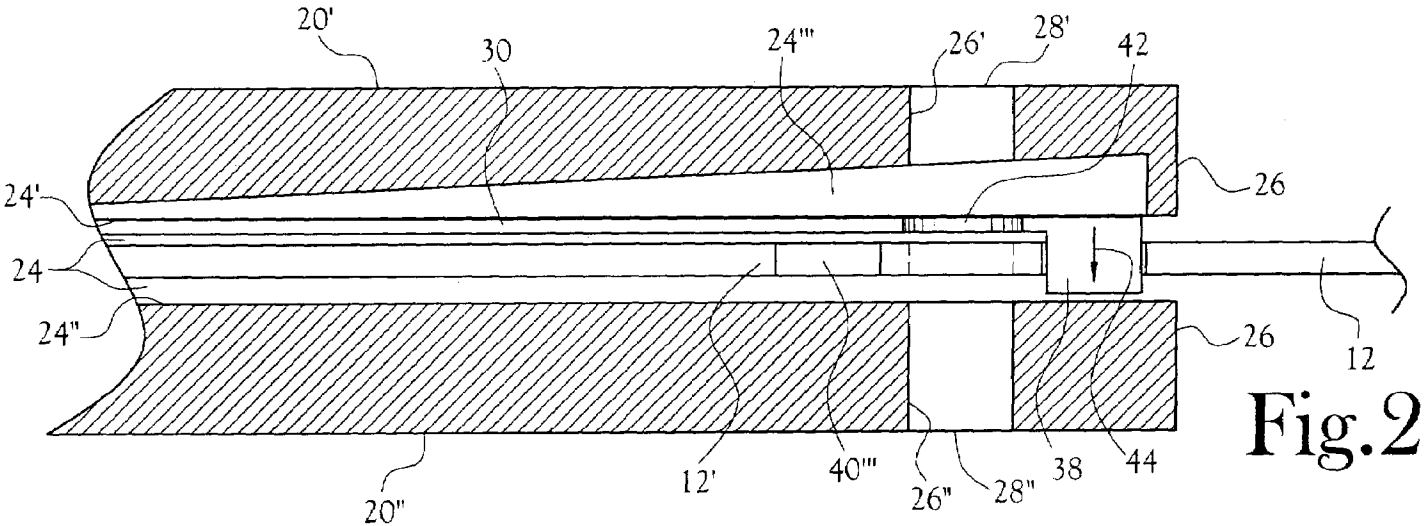
FIG. 2*a* is a view along section 2*a*—2*a* of FIG. 1, illustrating a means for locking disposed in an engaged and locked position against the blade within a channel extended through the length of the handle.
Figure 2B:
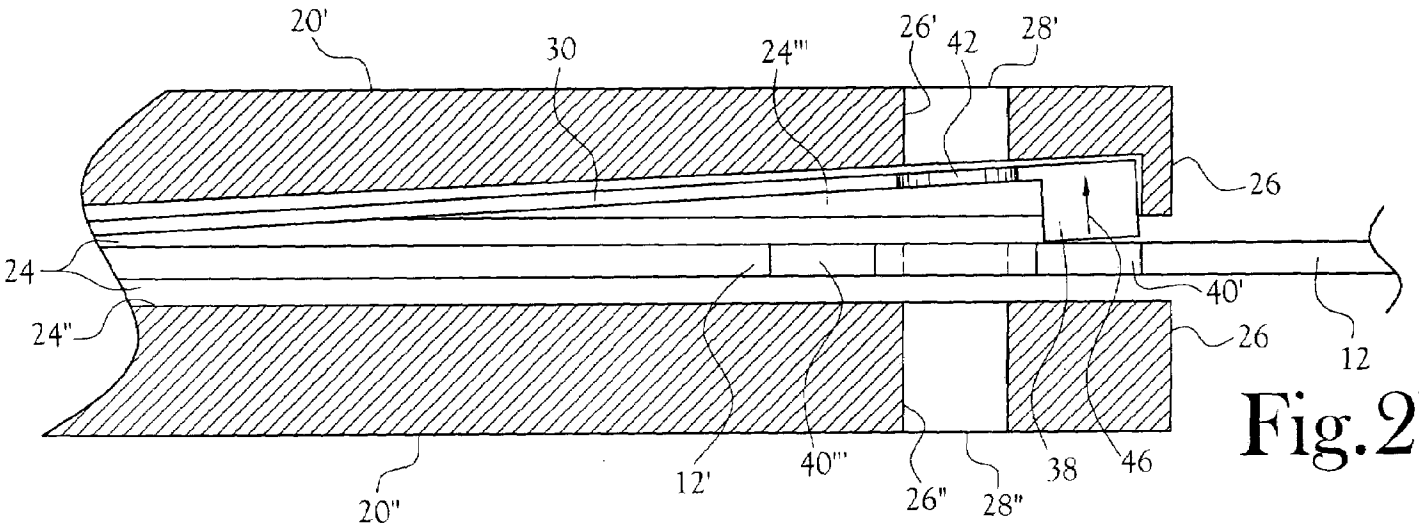
FIG. 2*b* is a view along section 2*a*—2*a* of FIG. 1, illustrating the means for locking in a disengaged position apart from the blade.

In order to provide a comfortable grip for the user's hand and to provide leverage for cutting or prying motions during use, the handle 20 includes a first handle section 20' aligned to be connected to a like-configured second handle section 20" (see FIGS. 1, 2*a* and 2*b*). The two handle sections 20', 20" are connected together by the base connector 22" and the pivot member 28 which pivotably secures the blade body section 12' proximal to a handle pivot end 26. Each handle section 20', 20" is preferably sized to have a length of approximately one or two inches greater than half of the length of the blade 12 in order for each handle base end 22 to extend an adequate length to cover the blade end section 14 or 16 that is concealed within the handle 20 when the opposed end is extended to an operative position from the pivot end 26. The two handle sections 20', 20" are spaced apart a sufficient width to form a blade channel 24 that extends the length of the handle 20 from the base end 22 to the pivot end 26 (see FIGS. 1, 2*a* and 2*b*). The blade channel 24 is bounded by interior surfaces 24', 2" of each handle section 20', 20".

In the embodiment illustrated in FIG. 1, an elongated handle includes two similar configured handle sections 20', 20" joined together at respective base ends 22 and having a base 32 of a locking member 30 disposed therebetween. In the embodiment illustrated, the exterior gripping surface of the handle base end 22 is substantially flat, but it will be understood that the exterior gripping surface can be generally curved. It is further understood that the two handle sections 20', 20" can include a generally rectangular cross-section when assembled with a pivotable blade 12 therebetween, and the exterior gripping surfaces can include contours to be shaped to fit comfortably within a user's hand closed around the two handle sections 20', 20".

Figure 3:
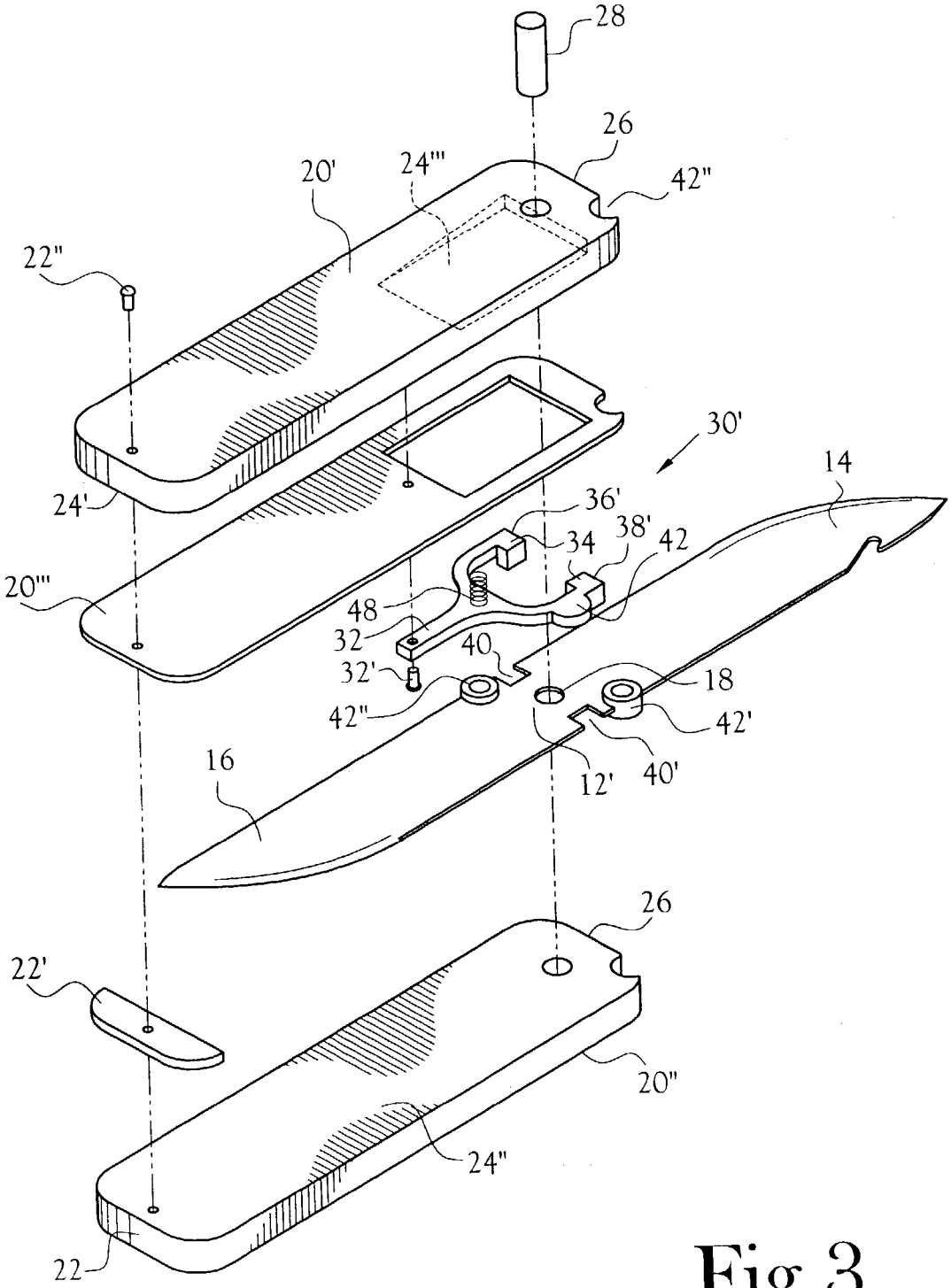
FIG. 3 is an exploded view of an alternative embodiment of a means for locking positioned proximal of a blade body section of the knife of FIG. 1.
Figure 6A:
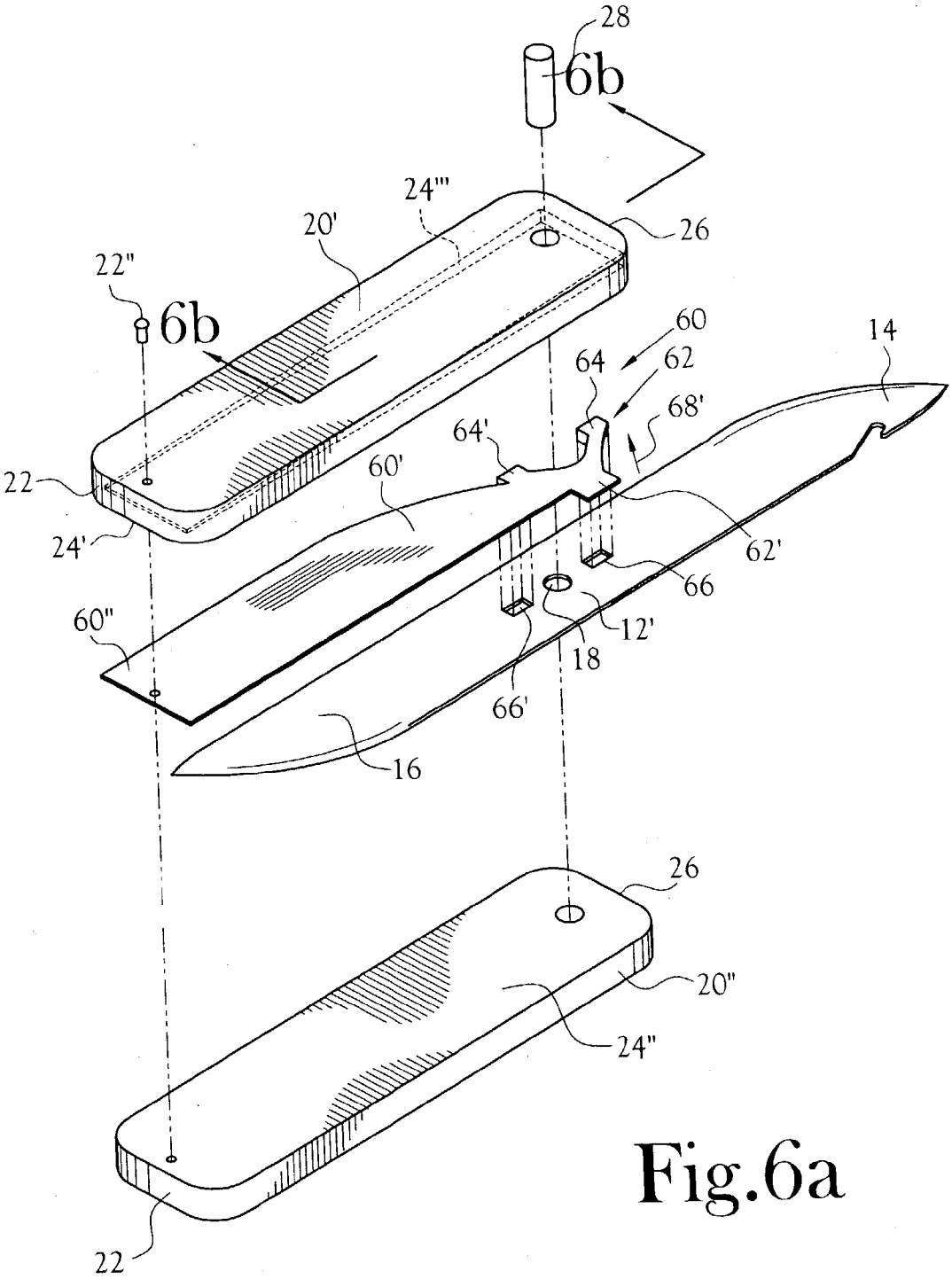
FIG. 6*a* is an exploded view of an alternative embodiment of a means for locking and an alternatively configured blade body section.
Figure 7:
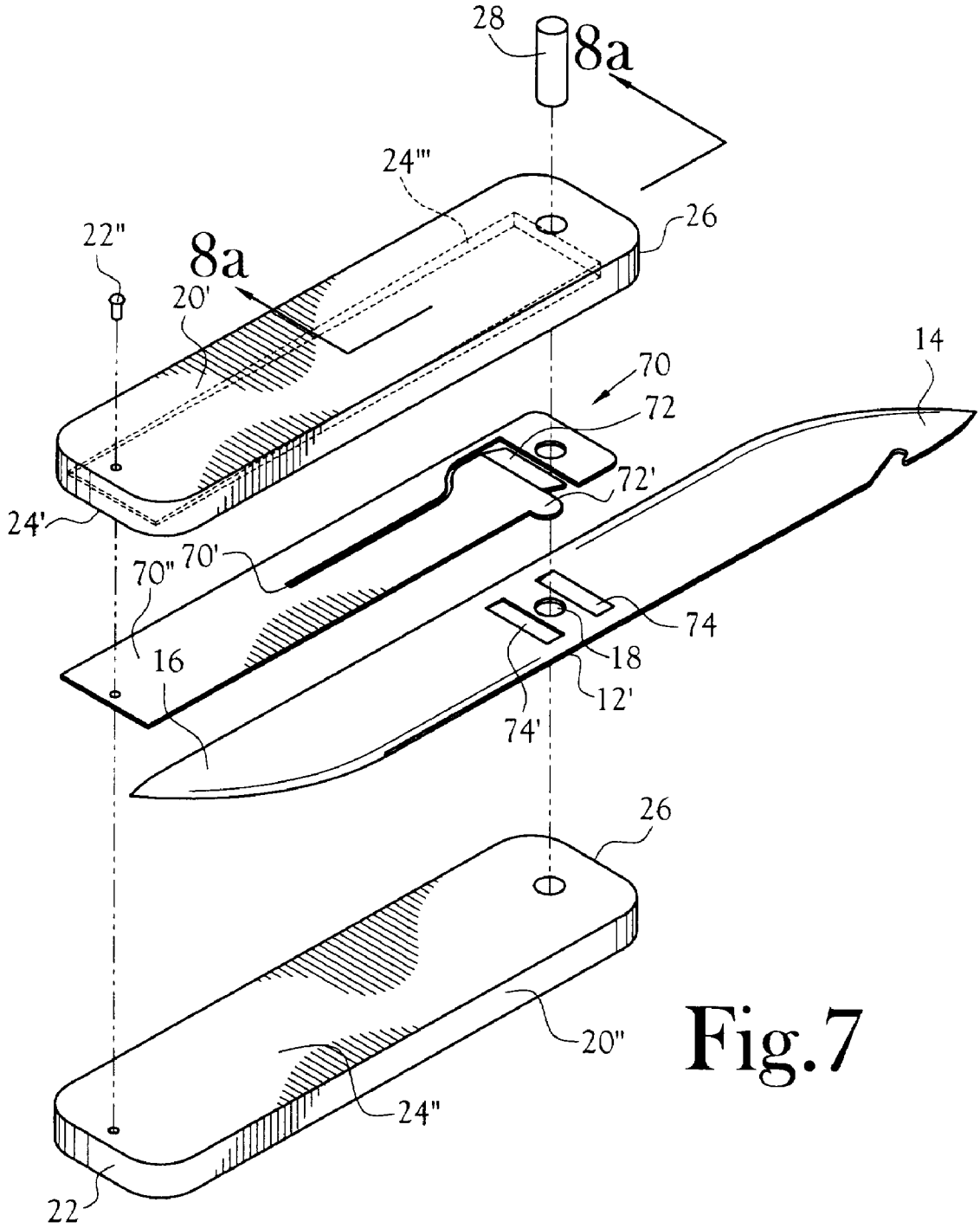
FIG. 7 is an exploded view of an alternative embodiment of a means for locking and an alternatively configured blade body section.

In order to secure the blade 12 from unwanted pivoting relative to the handle 20 during use, the locking member 30 is aligned proximal of the blade body section 12'. To provide a rigid locking of the blade body section 12' by the locking member 30, the blade body section 12' includes at least one slot-like lock opening 40 disposed on the blade body section 12'. The slot-like lock opening 40 is also identified herein as an engagement slot or opening, as illustrated in FIGS. 3, 6*a*, and 7. One embodiment for the engagement slots is illustrated in FIG. 1 and includes at least two pairs of locking slots 40, 40', 40", 40'" disposed in spaced-apart paired orientation along the side edges of the body section 12' and paired on opposed sides of the pivot opening 18. An additional embodiment is illustrated in FIG. 3 and includes one pair of engagement slots 40, 40' disposed in spaced-apart paired orientation along the side edges of the body section 12'.

As illustrated in FIG. 1, a recess 24'" is provided within the first handle section 20' to allow adequate internal width for movement of the locking member 30 apart from the blade body section 12'. The recess 24'" is oriented along the central portion of interior surface 24' and includes a first end recessed into the first handle section 20' at about a distance of between about three to four inches apart from the pivot end 26. The recess 24'" extends a sufficient length to accommodate the locking member 30, and extends from the pivot end 26 to approximately the base end 22 of the first handle section 20'. The external features of one or both handle sections 20', 20" can include a contoured outer side surface providing an indentation (not shown) in order to allow at least one of the user's digits to rest proximal to a release member 42 extended from the locking member 30 and through the blade channel 24. An internal liner 20'" having an opening therein can be aligned with recess 24'" to provide additional internal space within the blade channel 24 and proximal of the pivot end 26 for lateral movement of the locking member 30.

The pivot member 28 is removably inserted through the blade pivot opening 18 in order to pivotably support the blade 12 between the two handle sections 20', 20" of the handle 20. The pivot member 28 includes ends 28', 28" that are pivotably supported within aligned holes 26', 26" that extend through the respective widths of a first and second handle section 20', 20" (see FIG. 2*a*). The aligned holes 26', 26" are positioned at a distance of between about one inch to about three inches from the pivot end 26 (see FIGS. 1 and 3). The blade 12 is positioned within the handle 20 such that either of the blade end sections 14, 16 can be exposed in an operative position for utilization of a selected tool on either blade end section 14, 16. FIGS. 2*a* and 2*b* illustrate section views of the blade 12 rotatably secured within the blade channel 24 by the pivot member 28, with the locking member 30 illustrated in a locked position (see FIG. 2*a*), and in an unlocked position (see FIG. 2*b*) extended apart from the at least two engagement slots 40, 40'.

The locking member 30 provides a means for locking the blade 12 in a substantially rigid orientation within the handle 20 for a user to select and to utilize the selected blade end section 14, 16 to accomplish the user's intended purpose. The locking member 30 includes a generally elongated length that extends from a base 32 to an engagement end 34. The base 32 is secured by a pin or screw 32' against the inner handle surface 24' in order to allow the engagement end 34 to be moved from an engaged position against the blade body section 12' to a disengaged position within the recess 24'" in the interior surface 24' (see FIGS. 2*a* and 2*b*). The liner lock member 30 is preferably composed of a material such as spring steel having an inherent spring tension of the liner lock member 30 that biases the engagement end 34 against the blade body section 12'. The engagement end 34 includes a pair of insertion tabs 36, 38 that are oriented to extend from the interior faced surface of the engagement end 34 and toward the blade body section 12' (see FIG. 1). As illustrated at 44 in FIG. 2*a*, the insertion tabs 36, 38 are removably insertable into one pair of engagement slots 40, 40' of the two pair of engagement slots 40, 40', 40", 40'" in the blade body section 12'. The insertion tabs 36, 38 are moved apart from the blade body section 12' to a disengaged position as illustrated at 46 in FIG. 2*b*, by a user's manipulation of the release member 42 extended from the engagement end 34.

An alternative embodiment of a locking member is illustrated in FIG. 3, and provides a liner lock member 30' having a coiled spring 48 positioned against a middle portion of the length of the liner lock member 30'. The coiled spring 48, in combination with the spring steel composition of the liner lock member 30', serves to bias the engagement end 34 and insertion tabs 36', 38' into an engaged position 44 in the blade engagement slots 40, 40'. The liner lock member 30' flexes along its length when the user manipulates the release member 42 to move the engagement end 34 apart from the blade body section 12', thereby moving the insertion tabs 36, 38 to the disengaged position 46 within the recess 24'". The alternate configuration for a pair of insertion tabs 36', 38' is illustrated in FIG. 3, and provides a configuration having tabs 36', 38' extended inwardly of the "U-shaped" engagement end 34. The base 32 of the liner lock member 30' is attached by a connector 32' to an internal liner 20'" that can be positioned parallel to and between the first handle section 20' and the blade body section 12'. The handle base end 22 may include a spacer 22' (see FIG. 3) positioned to close the blade channel 24 at the base end 22, thereby providing a protective end segment for covering a blade tip of either end section 14, 16 disposed within the handle 20. The spacer 22' provides an additional benefit by providing a width separation between the handle sections 20', 20" to allow the blade channel 24 to accommodate a bulky blade pivotably secured therein.

Figure 4:
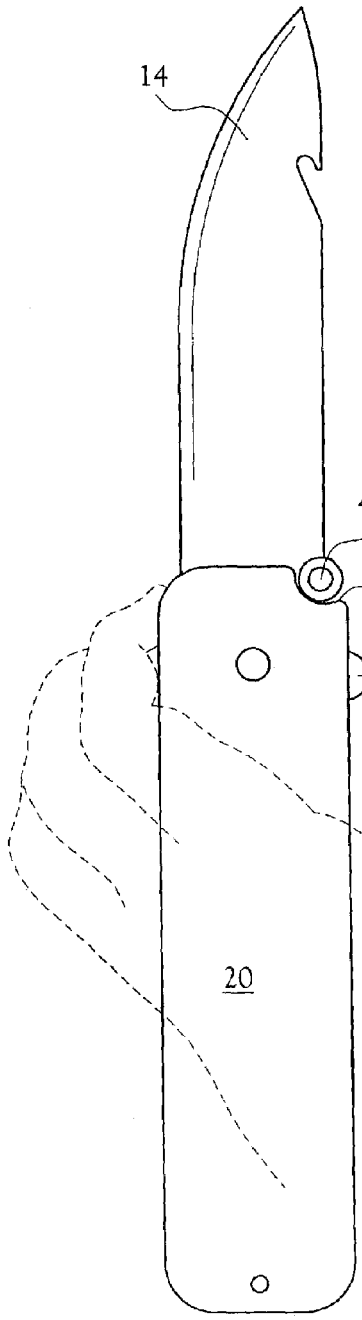
FIG. 4 is a side view of an operator's actuation of the means for locking to a disengaged position apart from the blade within the handle.
Figure 5:
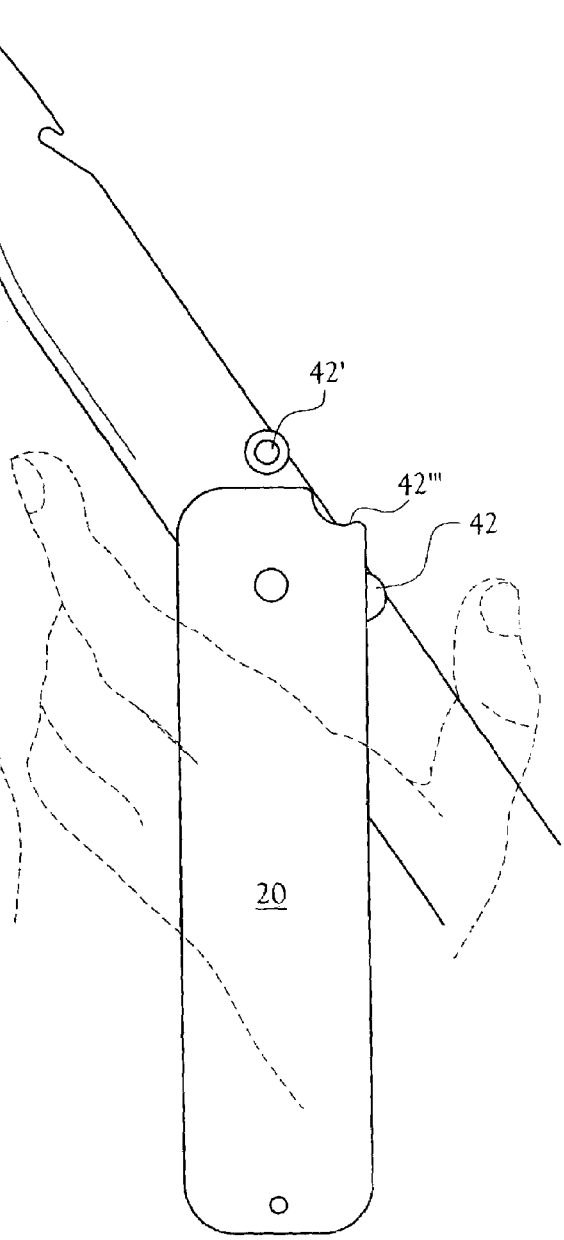
FIG. 5 is a side view of the blade partially pivoted by the user.

FIG. 4 illustrates a release member 42 being manipulated by a single digit of the user in order to disengage the internal lock member (not shown) from the blade body section 12', to thereby allow the user to cradle the handle 20 in one hand while the blade 12 is pivoted by the user about the pivot member 28 (see FIG. 5). Upon pivoting of the blade 12 within the blade channel 24 into a first or a second operative position, the user can position either the first blade end section 14 or the second blade end section 16 into the preferred operative position having the selected blade end section 14, 16 extended from the handle pivot end 26. Upon the user's release of the release member 42, the internal lock member 30 having insertion tabs 36, 38 extended therefrom, is moved into the engaged position 44 by the spring tension of the lock member 30, thereby locking the blade 12 into the preferred operative position. An alternative embodiment of the blade 12 includes a safety feature having at least one stop member 42', and preferably two stop members 42', 42", extendable from opposed sides of the blade 12 proximal of the body section 12' (see FIGS. 3–5). Either stop member 42', 42" can be slidably attached proximal of an outer edge of the blade body section 12' to enable the user to move the respective stop member 42', 42" laterally to extend a sufficient distance to be disposed within an indentation 42'" formed in the pivot end 26 of each handle sections 20', 20". When laterally extended, either stop member 42', 42" operates in cooperation with the liner lock member 30, to maintain the blade 12 in the locked and operative position, therefore decreasing the possibility of the blade 12 pivoting (see FIG. 5), if the user mistakenly engages the release member 42.

Figure 6B:
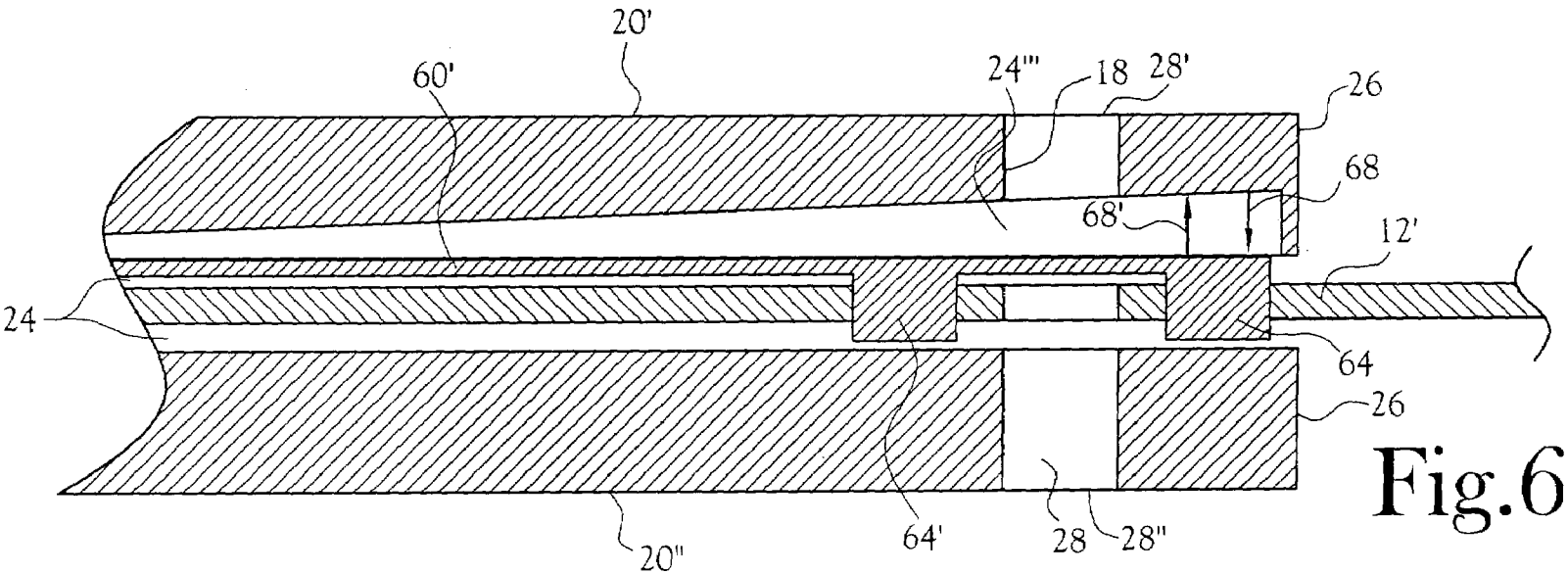
FIG. 6*b* is a view along section 6*b*—6*b* of FIG. 6*a*, illustrating the means for locking in an engaged and locked position against the blade body section.

An alternative embodiment of a lock member 60 and an appropriately configured blade body section 12' is illustrated in FIGS. 6*a* and 6*b*. The lock member 60 is generally elongated in length and is aligned adjacent the longitudinal axis of the blade body section 12'. The lock member 60 is preferably composed of a material having an inherent spring tension such as spring steel. A lock member mid-segment 60' is extends to a base segment 60" for connection to the interior surface 24' of the first handle section 20' by a connector 22" extended through a hole in the base segment 60". An engagement end 62 includes a pair of aligned insertion tabs 64, 64' that are positioned to be inserted into an engaged position against the blade body section 12' as illustrated by the arrow at 68 in FIG. 6*b*. The insertion tabs 64, 64' remain engaged in the respective engagement slots 66, 66' due to the spring tension of the lock member 60, thereby maintaining the blade 12 in a locked position within the blade channel 24. The insertion tabs 64, 64' are forced to disengage from the blade 12 to a disengaged position as illustrated by the arrow at 68' in FIG. 6*b* by a user's manipulation of a release member 62' extended from the engagement end 62. In the disengaged position, the engagement end 62 is positioned into the recess 24''' in handle section 20', thereby allowing the user to pivot the blade 12 about the pivot member 28 to extend either of the blade end sections 14, 16 into the operative position. When the release member 62' is released by the user, the insertion tabs 64, 64' return to the engaged position 68 in engagement slots 66, 66', thereby locking one end section of the blade 12 into an operative position.

Figure 8A:
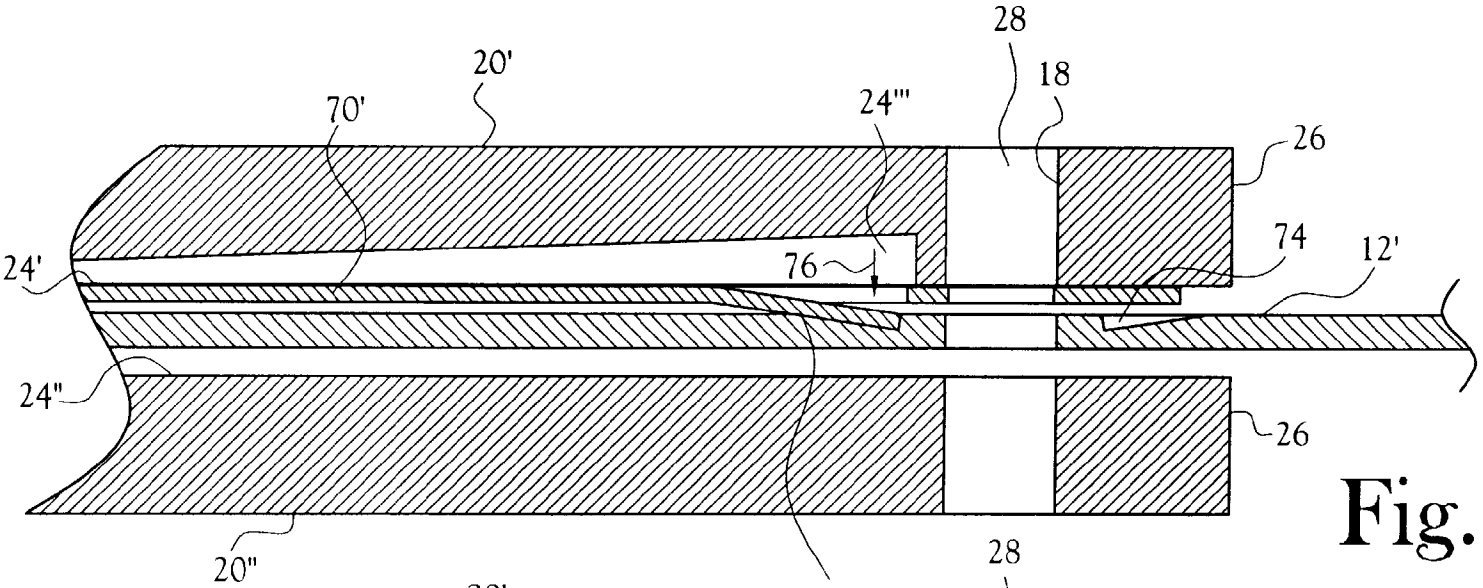
FIG. 8*a* is a view along section 8*a*—8*a* of FIG. 7, illustrating an engaged and locked position for the means for locking disposed against the blade body section.
Figure 8B:
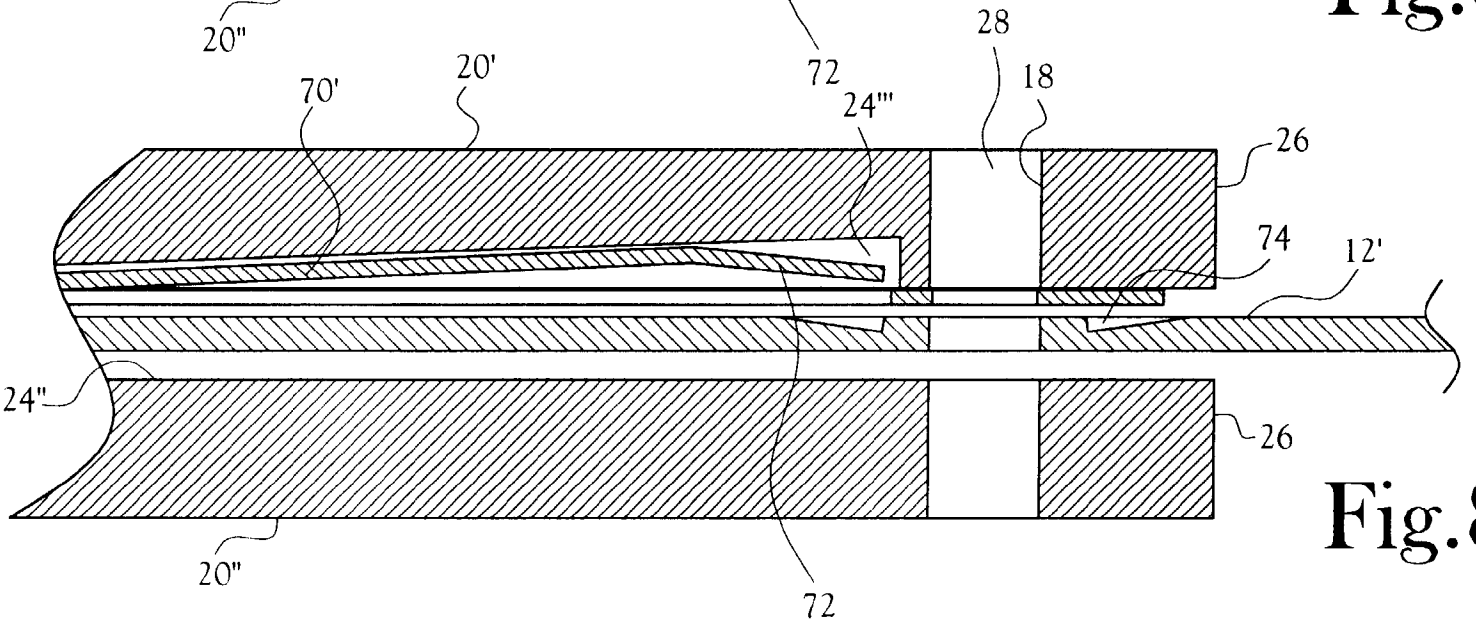
FIG. 8*b* is a view along section 8*a*—8*a* of FIG. 7, illustrating a disengaged position for the means for locking disposed apart from the blade.

An alternative configuration of a lock member 70 and an appropriately configured blade body section 12' are illustrated in FIGS. 7, 8*a*, and 8*b*. The lock member 70 includes an engagement end 72, an elongated mid-segment 70' and a base segment 70" connected to the interior surface 24' of the first handle section 20' by a connector 22" extended through aligned holes in the handle sections 20', 20". The lock member 70 is preferably composed of a material having an inherent spring tension such as spring steel. In order to accommodate the alternative configured engagement end 72, the blade body section 12' includes two elongated engagement slots 74, 74' that are aligned perpendicular to the longitudinal axis of the blade 12 and are positioned laterally across the width of the blade body section 12'. The slots 74, 74' are positioned in parallel relationship on the blade surface on opposite sides of the pivot opening 18. The slots 74, 74' may extend an adequate depth into the blade body section 12' (see FIGS. 8*a* and 8*b*), or alternatively, may extend entirely through the blade body section 12' (not shown). The engagement end 72 is removably insertable into one of the elongated slots 74 or 74' for engaging the blade body section 12' in a locked position as illustrated at 76 in FIG. 8*a*. The engagement end 72 is moved to an unlocked position apart from the blade body section 12' as illustrated at 78 in FIG. 8*b*, by a user's manipulation of a release member 72' extended from the engagement end 72. In the unlocked position 78, the engagement end 72 is positioned into the recess 24''' in handle section 20', thereby allowing the user to pivot the blade 12 about the pivot member 28 for extending either blade end section 14, 16 from the pivot end 26 in the operative position. Upon the user's release of the release member 72', the engagement end 72 is returned to the locked position 76 in one of the engagement slots 74, 74' (see FIG. 8*a*) by the spring tension of the lock member 70.

Figure 9:
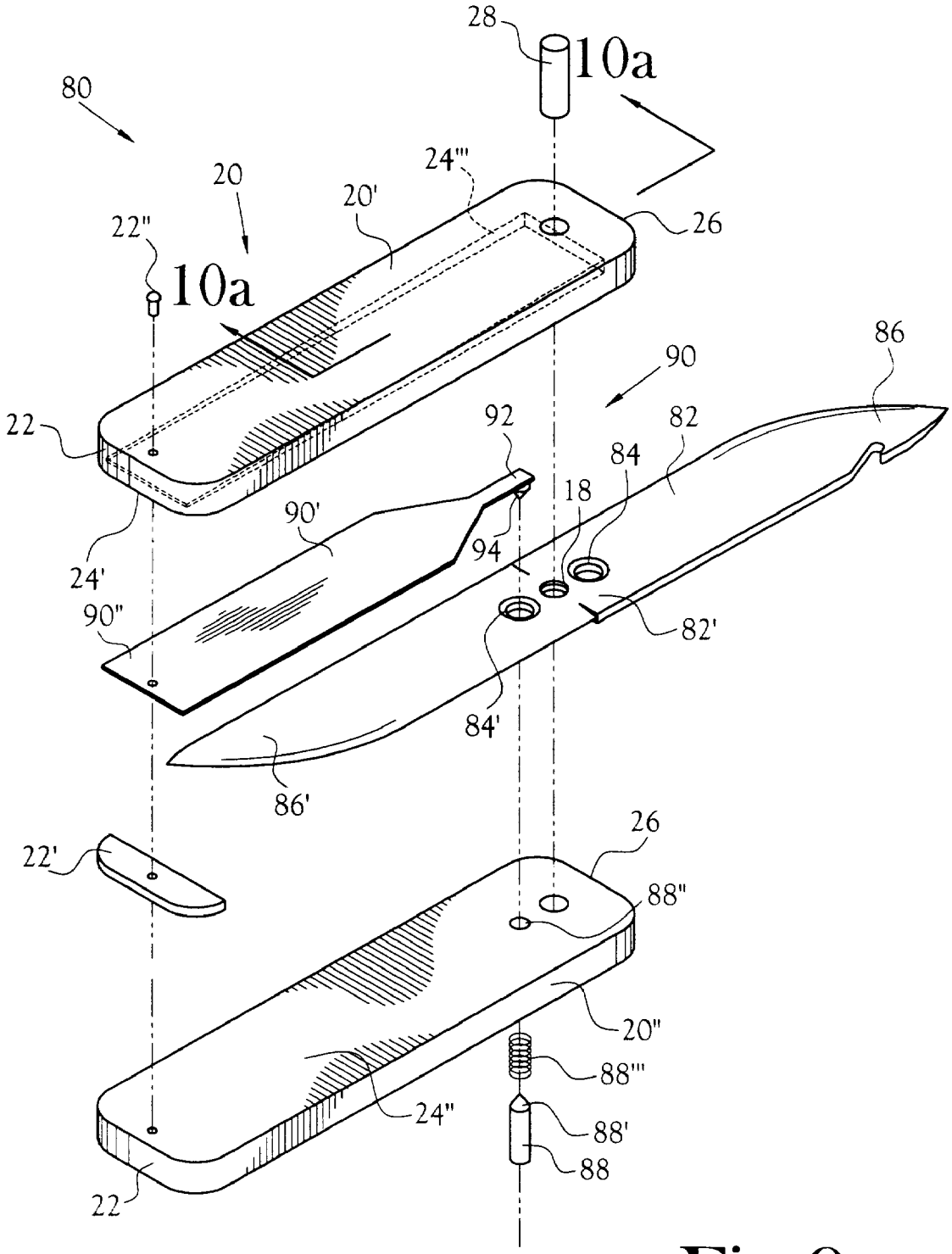
FIG. 9 is an exploded view of an alternative embodiment of a means for locking, an alternatively configured blade body section, and a release member for engaging and disengaging a blade pivotably disposed within a handle.
Figure 10A:
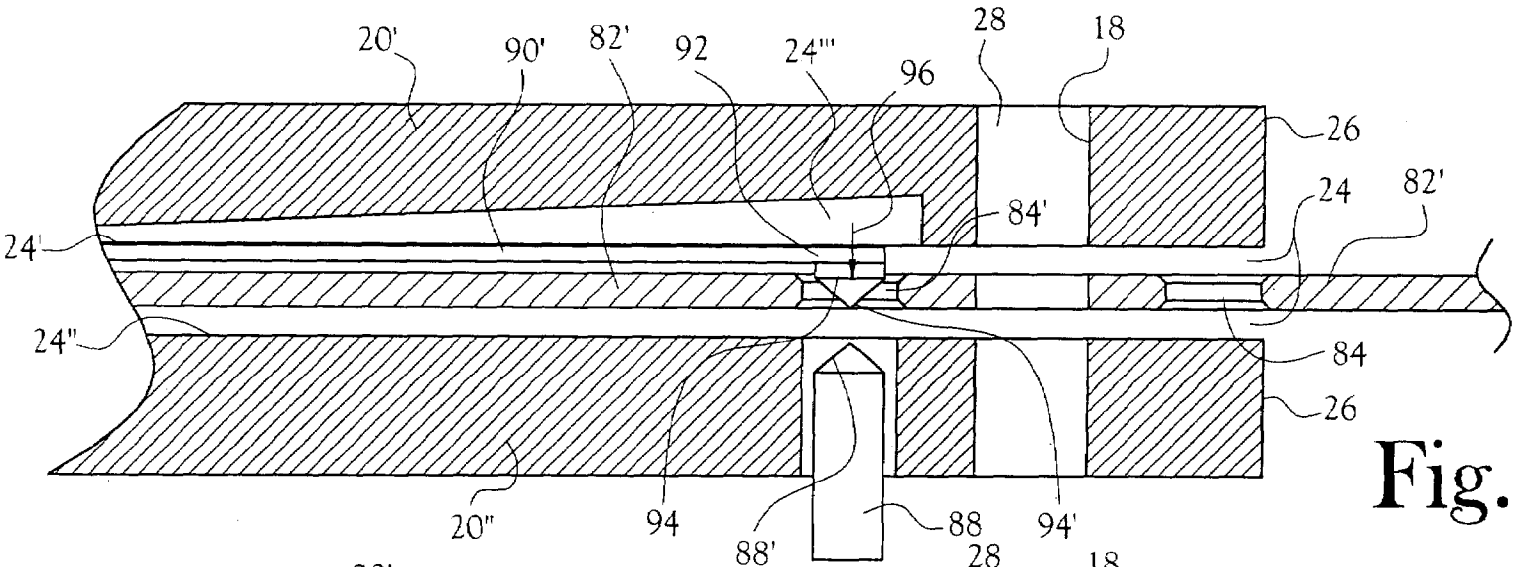
FIG. 10*a* is a view along section 10*a*—10*a* of FIG. 9, illustrating an engaged and locked position for a means for locking disposed against the blade body section.
Figure 10B:
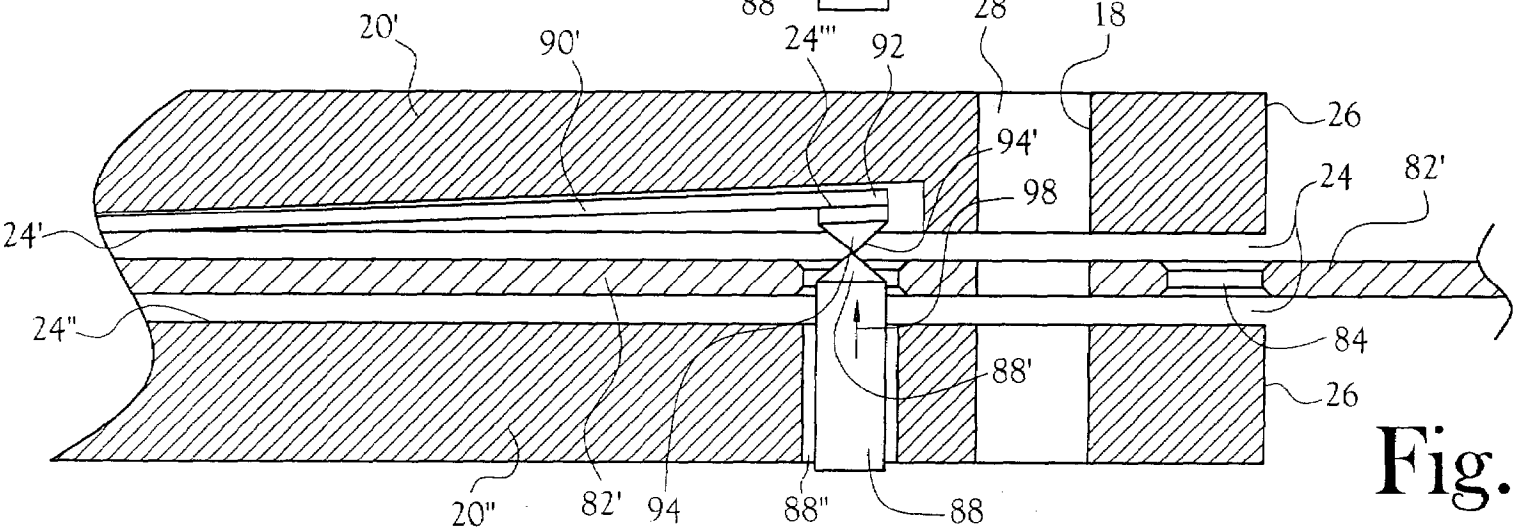
FIG. 10*b* is a view along section 10*a*—10*a* of FIG. 9, illustrating a disengaged position for a means for locking disposed apart from the blade.

An additional alternative embodiment of a lock member 90 and an appropriately configured blade body section 82' of a pivotable blade 82 are illustrated in FIGS. 9, 10*a*, and 10*b*. The lock member 90 includes a body portion 90' aligned adjacent to the blade body section 82'. The body portion 90' is preferably composed of a material having an inherent spring tension such as spring steel. A lock member base 90" is connected to the interior surface of the first handle section 20'. The blade body section 82' includes two engagement openings 84, 84' that are aligned along a longitudinal axis of the blade 82 and are positioned on opposed sides of the central pivot opening 18 in which the pivot member 28 is removably inserted. Each opposed blade surface opening of the engagement openings 84, 84' include a perimeter beveled to a larger diameter than the interior diameter of the engagement openings 84, 84' (see FIGS. 10*a* and 10*b*). The beveled perimeter of the holes 84, 84' facilitates an entry and an exit of a lock member pin 94 that is extended from an engagement end 92 of the lock member 90. The engagement end 92 is preferably biased by the spring steel material of the lock member body portion 90' into an engaged and locked position against the blade body section 82' as illustrated at 96 in FIG. 10*a*. The lock pin 94 remains engaged in one of the engagement openings 84 or 84' in order to maintain the blade 82 in the locked position 96 within the blade channel 24. The lock pin 94 includes a beveled end 94' that facilitates insertion of lock pin 94 into either of the engagement openings 84, 84' as the blade 82 is pivoted relative to the blade channel 24.

The lock pin 94 is moved apart from the locked position 96 to a disengaged and unlocked position as illustrated at 98 in FIG. 10*b*, by the manipulation and movement of a release member 88 by a user's finger or thumb. The release member 88 includes an elongated cylinder having a beveled interiorly oriented end 88' that is extended inwardly against the lock pin beveled end 94' by the user's finger or thumb pressing against the outer end of the release member 88. Upon manipulation by the user, the release member 88 extends through a hole 88" in the second handle section 20" and contacts the lock pin beveled end 94', thereby initiating the temporarily disengagement of the lock pin 94 from the locked position 96 in one engagement opening 84, 84'. In order to assist the contact of the release member end 88' against lock pin 94, the hole 88" is aligned with the interior positioned engagement opening 84 or 84' in which the lock pin 94 is inserted when in the locked position 96. Upon the user's manipulation of release member 88, thereby pushing the lock pin 94 out of the respective engagement opening 84, 84' and into the handle recess 24''', the user can one-handedly pivot the blade 82 and body section 82' around the pivot member 28. During pivoting of the blade 82, the release pin 88 remains in the non-engaging position within the hole 88" to allow unhindered pivoting of the body section 82' until the selected blade end section 86, 86' is exposed in the operative position extended from the handle pivot end 26. Upon alignment of the lock pin 94 with one engagement opening 84, 84', the spring tension of the lock member body portion 90' forces the lock pin beveled end 94' to the engaged, locked position 96 in one engagement opening 84, 84', thereby locking the blade 82 within the blade channel 24 to allow a user to work with the knife 80 without unwanted pivoting of the blade 82.

From the foregoing description, it will be recognized by those skilled in the art that an improved straight knife 10 is disclosed having a double-ended blade 12 or 82 with one pivot hole therein, having a minimal number of engagement slots in the blade, and having any one of the disclosed configurations for insertion of a locking member therein. The locking member is periodically manipulated by one digit of the user to rotate and expose either blade end of the blade into an operative position. The one pivot hole, the minimal number of engagement holes in the blade, and the locking member having any one of the disclosed configurations provide a simplified mechanism of operation and rotation of the double-ended blade 12 or 82 when compared to prior devices. Further, the one pivot hole and the minimal number of engagement holes in the blade maximizes the strength of the straight knife 10 by minimizing the holes through the blade 12 or 82.

A method of operation is provided for a user to actuate one of a plurality of configurations for a lock member 30, 30', 60, 70, or 90 as disclosed herein, in order to rotate the double-ended blade 12 into either of a first blade position or a second blade position. The first blade end 14 is positioned in an extended, locked position by the spring-biased movement of the lock member disposed in an engaged and locked position against the blade body section 12'. The second blade end 16 is pivotable to an exposed position by the user's manipulation of one of a plurality of configurations for a release member 42, 62', 72', or 88 as disclosed herein, to actuate movement of the lock member to a disengaged position. When unlocked, the user can one-handedly apply pressure against the blade, thereby pivoting the second blade end into an exposed positioned. The spring-biased lock member returns to the engaged and locked position against the body section of the blade. The method of operation provides for rapid deployment of either blade end of the double-ended blade for use by a user such as an emergency response person in order to cut, saw, pry or rotate an object impeding the completion of the user's task.

While the present invention has been illustrated by description of several embodiments in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A straight knife comprising:

a handle defining a blade channel defined along its longitudinal axis and having a pivot end and a base end, said blade channel opening outwardly each opposed along said pivot end and along both opposed handle sides;

a blade configured to be received within said blade channel, said blade having opposed end sections integrally formed with a body section pivotably connected within said blade channel proximal of said pivot end of said handle;

a pivot opening disposed in a center position of said blade body section;

at least two engagement slots disposed respectfully through opposed sides of said blade proximal of said pivot opening;

a pivot member releasably received through said blade pivot opening, said pivot member having opposed ends supported by opposed surfaces of said blade channel, said pivot member provides pivotable movement of said blade within said blade channel for exposure of either of said blades from said base end of said handle; and a locking member disposed within said blade channel proximal to said blade body section extending outwardly from opposing sides of said blade channel, said locking member having an engagement end biased to engage said at least two engagement slots in a locked position for said blade, said engagement end is manipulated by a user's digit for single-handedly disengaging said engagement end from said at least two engagement slots to an unlocked position for the user to single-handedly pivot said blade relative to said handle to extend either one of said opposed end sections from said handle wherein said locking member includes:

a spring means having a first end attached to one interior handle surface of said first handle section and having a spring body extended to said engagement end disposed proximal of said blade body section;

said engagement end having spaced-apart locking members extended therefrom, said locking members are laterally moved to insert within said at least two engagement slots in said locked position; and a release member extended from said engagement end, said release member having a manipulated end positioned to extend a sufficient distance from said blade channel for periodic manipulation by the user's digit for movement of said engagement end from said locked position to said unlocked position apart from said at least two engagement slots;

whereby when said engagement end is in said unlocked position, said blade is single-handedly pivoted by the user for extending either one of said opposed end sections from said handle.

2. The straight knife of claim 1 wherein said base end of said handle forms a gripping member, said gripping member having a contoured bottom surface to provide an indentation between said gripping member and said pivot end of said handle for receiving a user's digit therein for the user's single-handedly manipulation of said release member and said engagement end to said unlocked position.

3. The straight knife of claim 2 wherein said pivot member is removable from said pivot opening to allow removal said blade from said blade channel when said locking member is actuated by the user to a disengaged position from said blade, whereby the user can replace said blade with a like-sized blade having opposed ends each forming a selected tool for the user's application.

* * * * *